US010167756B2

(12) United States Patent
Marquardt-Stammberger et al.

(10) Patent No.: US 10,167,756 B2
(45) Date of Patent: Jan. 1, 2019

(54) MUFFLER FOR AN EXHAUST SYSTEM OF AN INTERNAL COMBUSTION ENGINE

(71) Applicant: Eberspächer Exhaust Technology GmbH & Co. KG, Neunkirchen (DE)

(72) Inventors: Michael Marquardt-Stammberger, Münsingen (DE); Roland Schwarz, Esslingen (DE); Thomas Uhlemann, Stuttgart (DE); Mathias Rothfuß, Waiblingen (DE); Martin Straehle, Wendlingen (DE); Benjamin Roehr, Esslingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 49 days.

(21) Appl. No.: 15/334,937

(22) Filed: Oct. 26, 2016

(65) Prior Publication Data

US 2017/0122154 A1 May 4, 2017

(30) Foreign Application Priority Data

Oct. 30, 2015 (DE) ..... 10 2015 118 573

(51) Int. Cl.

| | |
|---|---|
| ***F01N 1/02*** | (2006.01) |
| ***F01N 1/00*** | (2006.01) |
| ***F01N 13/08*** | (2010.01) |
| ***F01N 13/18*** | (2010.01) |
| ***G10K 11/172*** | (2006.01) |
| *G10K 11/16* | (2006.01) |

(52) U.S. Cl.

CPC ..... *F01N 1/023* (2013.01); *F01N 1/003* (2013.01); *F01N 1/026* (2013.01); *F01N 13/08* (2013.01); *F01N 13/1838* (2013.01); *G10K 11/172* (2013.01); *F01N 2470/02* (2013.01); *F01N 2470/04* (2013.01); *F01N 2490/155* (2013.01); *G10K 11/161* (2013.01)

(58) Field of Classification Search

CPC ..... F01N 1/023; F01N 1/003; F01N 1/026

USPC ..... 181/272

See application file for complete search history.

(56) References Cited

U.S. PATENT DOCUMENTS 2,928,492 A * 3/1960 Nelson ..... F01N 1/02 181/275

4,064,962 A * 12/1977 Hunt ..... F01N 1/02 181/272

(Continued)

FOREIGN PATENT DOCUMENTS

DE 82 03 483 U1 9/1982

DE 34 17 131 A1 11/1985

(Continued)

*Primary Examiner* — Jeremy Luks

(74) *Attorney, Agent, or Firm* — McGlew and Tuttle, P.C.

(57) ABSTRACT

A muffler for an exhaust system of an internal combustion engine includes a housing with a circumferential wall. At least one resonator chamber (48) is defined by the circumferential wall and two base walls (28, 22), that are provided in the housing. At least one resonator pipe (50), with a first pipe end (51) and with a second pipe end (56), is connected to one of the base walls (28) in the area of a first opening (52) in the one of the base walls (28). In the alternative or in addition the one of the base walls (28) traverses an interior space such that the first pipe end (51) lies outside of the resonator chamber (48), with the second pipe end (56) being fixed to the other base wall (22).

19 Claims, 3 Drawing Sheets

(56) References Cited

U.S. PATENT DOCUMENTS

| | | | | | |
|---|---|---|---|---|---|
| 4,192,403 | A * | 3/1980 | Nakagawa | F01N 1/089 | 181/268 |
| 4,867,768 | A * | 9/1989 | Wagner | F01N 3/0211 | 181/231 |
| 5,025,890 | A * | 6/1991 | Hisashige | F01N 1/02 | 181/256 |
| 5,048,287 | A * | 9/1991 | Howe | F01N 1/02 | 181/231 |
| 6,102,154 | A * | 8/2000 | Liu | F01N 1/02 | 181/237 |
| 2002/0033304 | A1* | 3/2002 | Watanabe | F01N 1/02 | 181/275 |
| 2005/0126850 | A1* | 6/2005 | Yamaguchi | F01N 1/02 | 181/249 |
| 2009/0145689 | A1* | 6/2009 | Han | F01N 1/084 | 181/272 |
| 2010/0307865 | A1* | 12/2010 | Olsen | F01N 1/084 | 181/272 |
| 2012/0168245 | A1* | 7/2012 | Wakatsuki | F01N 1/02 | 181/228 |
| 2016/0281559 | A1* | 9/2016 | Gommans | F01N 1/003 | |

FOREIGN PATENT DOCUMENTS

| | | | |
|---|---|---|---|
| GB | 2 367 094 | A | 3/2002 |
| JP | S60 175718 | A | 9/1985 |
| JP | S62 121818 | A | 6/1987 |

* cited by examiner

MUFFLER FOR AN EXHAUST SYSTEM OF AN INTERNAL COMBUSTION ENGINE

CROSS REFERENCE TO RELATED APPLICATIONS

This application claims the benefit of priority under 35 U.S.C. § 119 of German Application 10 2015 118 573.3 filed Oct. 30, 2015, the entire contents of which are incorporated herein by reference.

FIELD OF THE INVENTION

The present invention pertains to a muffler for an exhaust system of an internal combustion engine.

BACKGROUND OF THE INVENTION

Such a muffler generally comprises a housing having a circumferential wall. A resonator chamber defined by two base walls is provided in the interior of the housing enclosed by the circumferential wall for improving the muffling properties. In their outer circumferential area, the two base walls may be connected to the circumferential wall, and preferably without interruptions. The resonator chamber is open toward other volume areas of the housing interior only via a resonator pipe which traverses one of the base walls or which is connected to an opening in this base wall. It is possible to tune the muffling characteristic of a muffler having this configuration to a defined frequency or to a defined frequency range especially by setting the length of such a resonator pipe, which is also generally called a Helmholtz resonator pipe.

SUMMARY OF THE INVENTION

An object of the present invention is to provide a muffler for an exhaust system of an internal combustion engine, which, having a simple and stable configuration, has a muffling characteristic that is good and can easily be tuned to defined frequencies or frequency ranges.

According to the present invention, this object is accomplished by a muffler for an exhaust system of an internal combustion engine, comprising a housing with a circumferential wall, wherein at least one resonator chamber defined by the circumferential wall and two base walls is provided in the housing, further comprising at least one resonator pipe with a first pipe end and with a second pipe end, wherein the resonator pipe is connected to the one base wall in the area of a first opening in one of the base walls or/and the one base wall traverses such that the first pipe end lies outside of the resonator chamber, the second pipe end being fixed to the other base wall.

In the configuration according to the present invention, the resonator pipe with the resonator pipe second pipe end lying in the resonator chamber is fixed to a base wall defining this resonator chamber. It is thus possible to also mount a resonator pipe having a correspondingly long configuration and projecting comparatively far into the resonator chamber, i.e., due to the tuning to a defined frequency both in a stable manner and against vibration excitations.

The second pipe end is preferably in flush contact with the other base wall, or/and a bulge formed on the other base wall meshes with the resonator pipe at the second pipe end. The resonator pipe may be fixed to the other base wall by material connection, for example, by welding.

In order to achieve the defined muffling characteristic including the functionality of a Helmholtz resonator, on the one hand, and to be able to ensure the stable mounting mentioned above, on the other hand, it is suggested that the resonator pipe starting from the first pipe end comprise a first resonator pipe section with a pipe wall without openings and starting from the second pipe end comprise a second resonator pipe section connected to the first resonator pipe section, the resonator pipe being open toward the resonator chamber in the area of the second resonator pipe section. The first pipe section, in which the pipe wall of the resonator pipe has no openings, essentially defines the length of action of the resonator pipe relevant for the muffling characteristic, while the second resonator pipe section open toward the resonator chamber essentially does not have an effect on the acoustic characteristic and is primarily used for the stable mounting of the resonator pipe on the other base wall. It is thus ensured that the resonator pipe is firmly supported on the one base wall, on the one hand, namely in the area of the first opening of same, and is firmly supported on the other wall, on the other hand, namely with its second resonator pipe section.

The resonator pipe may have at least one opening, preferably a plurality of openings in the second resonator pipe section. These openings may have a wide variety of configurations. The resonator pipe in its second resonator pipe section may, for example, have a plurality of holes, configured, for example, with a circular cross section such that the second resonator pipe section is an essentially perforated pipe section. As an alternative or in addition, provisions may be made for at least one elongated opening, preferably a plurality of elongated openings to be provided in the second resonator pipe section. At least one elongated opening may be elongated, for example, essentially in a longitudinal direction of the resonator chamber and may possibly be open toward the second pipe end. The second resonator pipe section may thus be formed, for example, with a plurality of web-like wall sections providing connection to the other base wall and interrupted by slot-like openings. The second resonator pipe section may be configured in an alternative embodiment, for example, with a circumferential area of the pipe wall and is thus open toward the resonator chamber via this remaining circumferential area or the end area of the first resonator pipe section.

In order to be able to discharge exhaust gases from the housing interior, it is suggested that at least one exhaust gas outlet pipe be connected to the one base wall in the area of a second opening in the one base wall and connected to the other base wall in the area of a third opening in the other base wall.

The one base wall, i.e. that base wall, on which the resonator pipe is preferably firmly supported in the area of its first resonator pipe section traversing the first opening or connected thereto, may be, for example, an inner base wall separating the resonator chamber from an exhaust gas-carrying chamber. The other base wall may be an outer base wall closing the housing to the outside, via which the exhaust gases leaving the muffler are discharged, for example, through the exhaust gas outlet pipe.

An exhaust gas inlet pipe leading into the exhaust gas-carrying chamber may be provided for introducing the exhaust gases into the muffler. Further, the first pipe end of the resonator pipe may lie in the exhaust gas-carrying chamber such that an acoustic connection between the exhaust gas-carrying chamber and the resonator chamber is established via the resonator pipe.

The present invention pertains, further, to an exhaust system for an internal combustion engine with a muffler according to the present invention.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
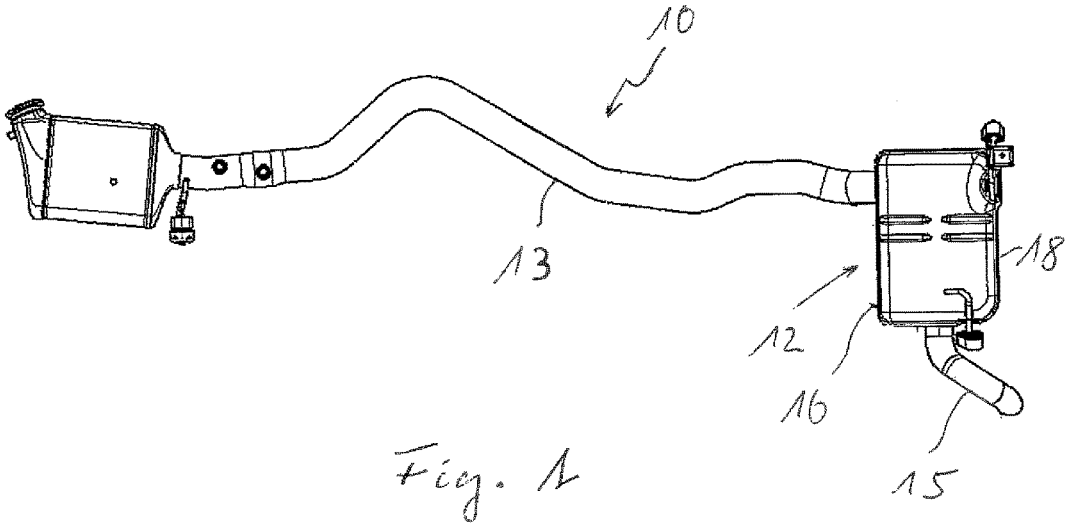
FIG. 1 is a top view of an exhaust gas-carrying system of an internal combustion engine with a muffler.

Referring to the drawings, an exhaust system for the internal combustion engine of a motor vehicle is generally designated by 10 in FIG. 1. The exhaust system 10 comprises an exhaust gas-carrying pipe 13 leading the exhaust gases of an internal combustion engine to a muffler, which is generally designated by 12. The exhaust gases introduced into the muffler 12 are released from this muffler in the area of a tail pipe 14 and are discharged via the tail pipe 14 to the environment. The muffler 12 comprises a housing 16 with a circumferential wall 18 that is approximately cylindrical and preferably made of sheet metal material. At the two end areas of the circumferential wall 18, this circumferential wall is connected permanently and in a gastight manner, for example, by welding to outer base walls 20, 22 shown in FIG. 2 such that an interior space of the housing 16 of the muffler 12, generally designated by 24, is sealed, in principle, in a gas-tight manner by the circumferential wall 18 and the two outer base walls 20, 22.

Two inner base walls 26, 28, which are rigidly connected to the circumferential wall, for example, by welding and which are arranged spaced apart from one another and also spaced apart from the outer base walls 20, 22 and preferably also over their entire circumference, are provided between the two outer base walls 20, 22. An exhaust gas inlet pipe 30 is rigidly connected to the outer base wall 20, for example, by welding in the area of an inlet opening 32 provided in the outer base wall 20 and may be rigidly connected to the exhaust gas-carrying pipe 13, for example, by welding or by gastight insertion connection for the integration of the muffler 12 into the exhaust system 10. The exhaust gas inlet pipe 30 traverses an opening 34 in the inner base wall 26 and extends up to the inner base wall 28. A bulge 36, which may extend into the end area of the exhaust gas inlet pipe 30, may be provided on the inner base wall 28 in order to provide a defined positioning and a secure mounting for the exhaust inlet pipe 30. This exhaust inlet pipe may be connected by material connection, for example, by welding to the inner base wall 28 in this area.

An exhaust gas-carrying chamber, which is generally designated by 38, into which the exhaust gases fed via the exhaust gas inlet pipe 30 can enter through a plurality of holes 40 provided in the exhaust gas inlet pipe 30 especially in the area between the two inner base walls 26, 28, is formed between the outer base wall 20 and the inner base wall 28.

An exhaust gas outlet pipe 42 is gastightly connected to the inner base wall 28, for example, by welding in the area of an opening 44 and in the area of an opening 46 in the outer base wall 22 is gastightly connected to same, for example, by welding. The exhaust gas outlet pipe 42 may extend slightly beyond the outer base wall 22 and may be or become gastightly connected to the tail pipe 14 in this area, for example, by welding or/and insertion connection. The exhaust gas outlet pipe 42 traverses, in a gastight manner, a resonator chamber 48 formed between the inner base wall 28 and the outer base wall 22 and establishes a connection between the exhaust gas-carrying chamber 38 and the tail pipe 14 and thus the external environment.

Figure 3:
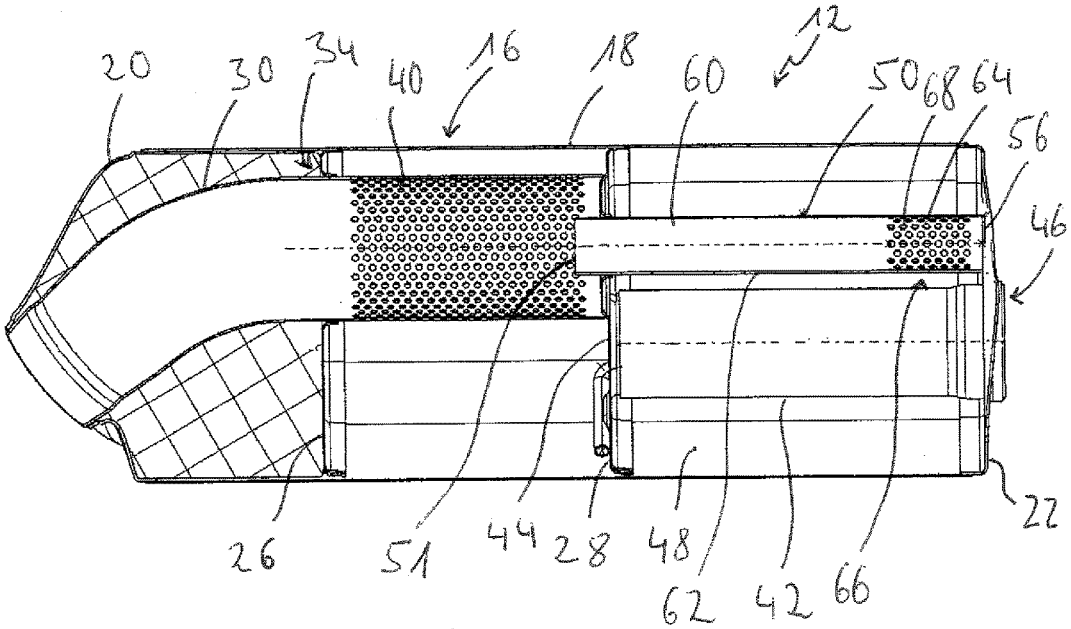
FIG. 3 is a longitudinal sectional view of the muffler of FIG. 1.
Figure 4:
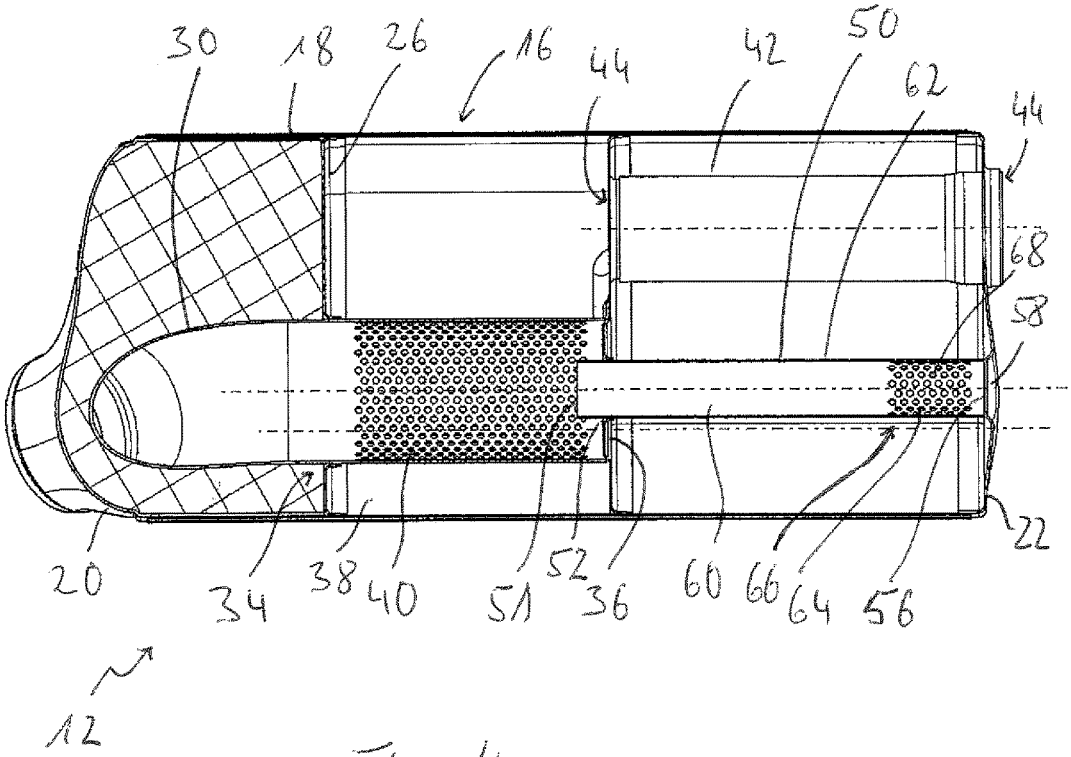
FIG. 4 is a longitudinal sectional view corresponding to FIG. 3, as viewed from a different side.

A resonator pipe 50, which is generally designated as a Helmholtz resonator pipe, is rigidly and gastightly connected to the inner base wall 28, for example, by welding in the area of an opening 52. As this can be clearly seen in FIGS. 3 and 4, the resonator pipe 50 traverses the opening 52 provided in the inner base wall 28 and lies with a first pipe end 54 in the exhaust gas-carrying chamber 38. In particular, the opening 52 may be provided in the area of the bulge 36 provided for the defined positioning of the exhaust gas inlet pipe 30 such that the resonator pipe 50 with its first pipe end 54 is positioned, for example, essentially centrally in the exhaust gas inlet pipe 30.

Figure 2:
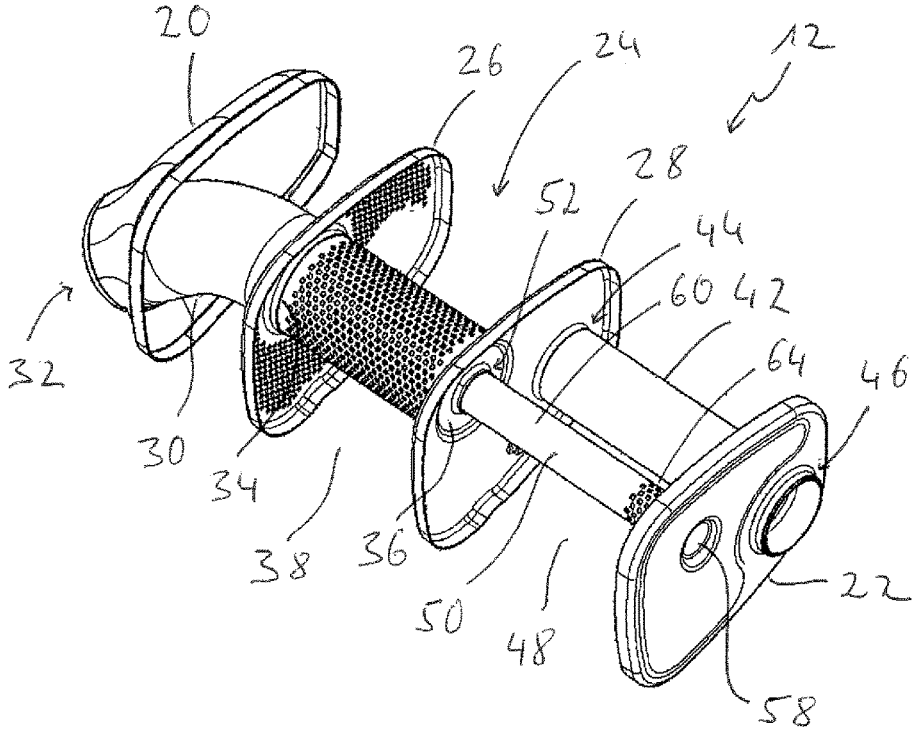
FIG. 2 is perspective view showing an internal configuration of the muffler of FIG. 1 with the circumferential wall of a housing of the muffler omitted.

The resonator pipe 50 extends through the resonator chamber 48 and with a second pipe end 56 is in flush contact with the inner side of the outer base wall 22. A bulge 58, which is directed inwards, i.e., toward the interior 24 in the outer base wall 22, as this is shown in FIG. 2, which meshes with the interior of the resonator pipe 50, for example, in the area of the second pipe end 56 in order to mount same in a centered manner, or is in contact with the second pipe end 56, may be provided as well. A stable connection of the resonator pipe 50 both to the inner base wall 28 and to the outer base wall 22 can be achieved, for example, by material connection, especially by welding.

Starting from the first pipe end 54, the resonator pipe 50 has a first resonator pipe section 60, in which a pipe wall 62 of the resonator pipe 50 has no openings. The first pipe section 60 is that section of the resonator pipe, which defines the acoustic action thereof Starting from the second pipe end 56, the resonator pipe 50 has a second resonator pipe section 64, which extends up to the first resonator pipe section 60, i.e., is connected to same, and in which a plurality of openings 66 are formed in the example shown. In the example shown in FIGS. 2 through 4, these openings 66 are configured as holes 68 with, for example, an essentially circular cross section. The holes 68 may be arranged in a regular pattern and form a perforation, via which the resonator pipe 50 is open toward the resonator chamber 48 in its second resonator pipe section 64.

The second resonator pipe section 64 is used essentially or primarily for connecting and supporting the resonator pipe 50 to/on the housing 16, especially the outer base wall 22, and is acoustically essentially not active due to the plurality of openings 66 and holes 68. However, providing the second resonator pipe section 64 makes it possible to configure the resonator pipe 50 with a comparatively long first resonator pipe section 60 extending in the area of the resonator chamber 48 and extending from the exhaust gas-carrying chamber 38 into the resonator chamber 48 and at the same time to avoid the occurrence of oscillations of the resonator pipe 50 caused by vibrations. This stable connection of the resonator pipe 50 is achieved in a structurally simple manner and avoids the need to have to provide a lateral support, for example, on the outlet pipe 42.

Figure 5:
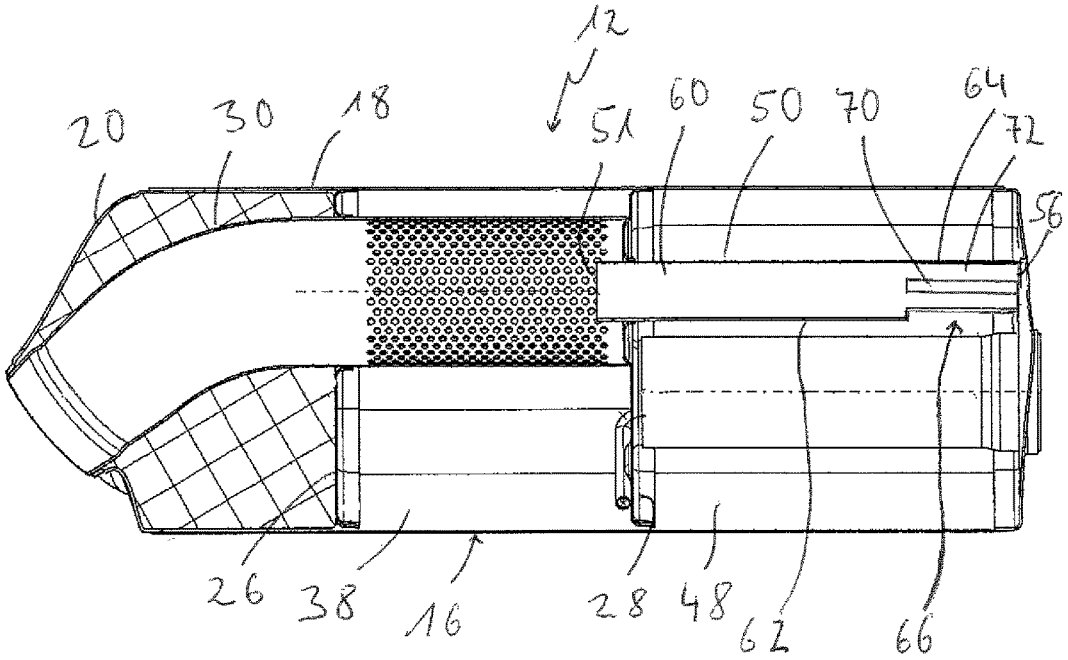
FIG. 5 is a sectional view corresponding to FIG. 3 of an alternative configuration of the muffler.

A variant of the muffler 12 is shown in FIG. 5. It is seen that in this variant the resonator pipe 50 in its second resonator pipe section 64 is formed with a plurality of openings 70 elongated in the longitudinal direction of the resonator pipe 50 and open toward the second pipe end 56 in the example shown, which provide the openings 66 in the second resonator pipe section 64 in this exemplary embodiment. The elongated openings 70 essentially form interruptions in the pipe wall 62, via which the resonator pipe 50 is open toward the resonator chamber 48. The web-like sections 72 of the pipe wall 62 formed between the openings 70 are preferably fixed by welding to the outer base wall 22 in the area of the second pipe end 56.

Figure 6:
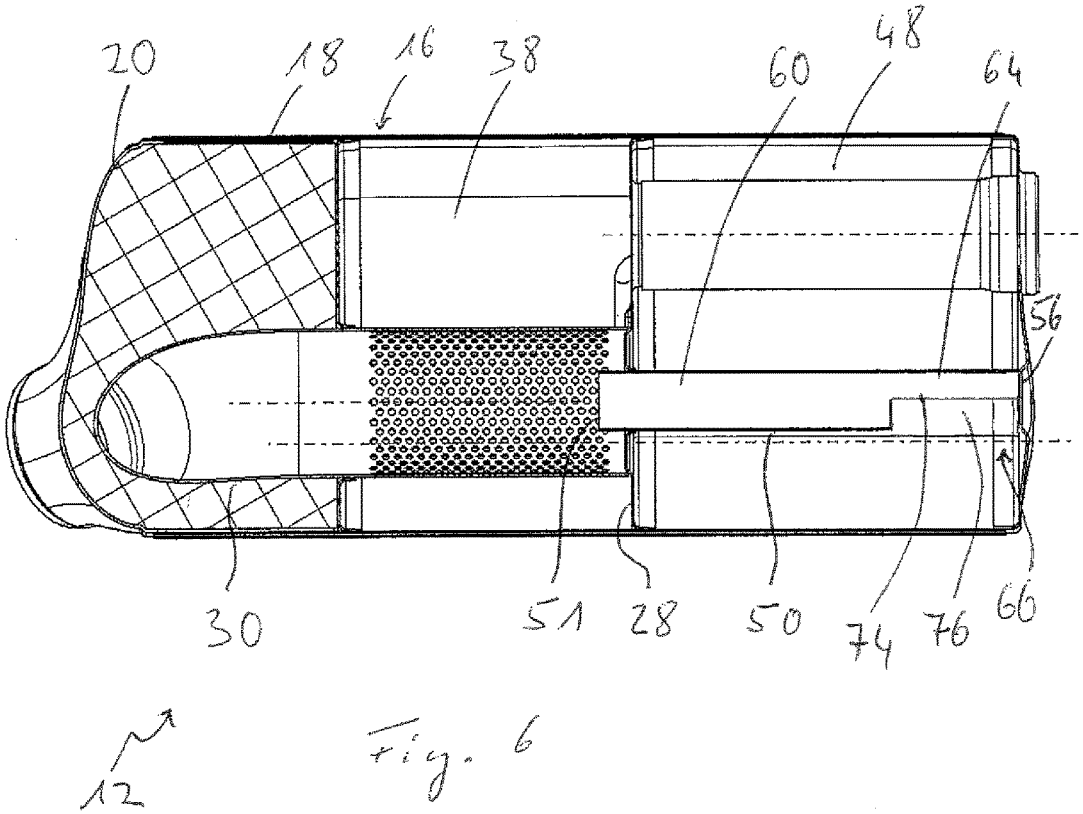
FIG. 6 is a view corresponding to FIG. 4 of another alternative configuration of the muffler.

Another variant is shown in FIG. 6. It is seen here that a part of the pipe wall 62 is missing in the second resonator pipe section 64 such that the second resonator pipe section 64 is essentially provided by a circumferential section 74 of the pipe wall 62. In this exemplary embodiment, the missing area 76 of the pipe wall forms an opening 66, via which the resonator pipe 50, connecting to the first resonator pipe section 60, is open toward the resonator chamber 48. The pipe wall section 74 may in turn be fixed to the outer base wall 22 by welding in the area of the second pipe end 56.

Also in the exemplary embodiments shown in FIGS. 5 and 6, the length of the acoustically active area of the resonator pipe 50 is essentially determined by the length of the first resonator pipe section 60, while the second resonator pipe section 64 connected to the first resonator pipe section 60 shows essentially no action acoustically, but rather makes possible a stable connection of the resonator pipe 50 at its second pipe end.

It should be pointed out that in the scope of the present invention, a wide variety of structural variations of the muffler described above and shown in the figures can be provided. Thus, the first pipe end 51 of the resonator pipe 50 does not necessarily have to be positioned in the interior of the exhaust gas inlet pipe 30. A positioning laterally next to the exhaust gas inlet pipe, especially also in an area outside of the bulge 36, is possible. Furthermore, the resonator chamber 48, which is essentially only open toward the exhaust gas-carrying chamber 38 via the resonator pipe 50, may also be formed between two inner base walls, through which the outlet pipe 42 can discharge the exhaust gases from the interior 24 of the housing 16. Further, two exhaust gas outlet pipes 42, which are adjacent and discharge exhaust gases from the interior 42, may be provided. As an alternative, provisions could also be made for an exhaust gas-carrying pipe or an additional exhaust gas-carrying pipe to lead out of the volume area of the interior 24 formed between the inner base wall 26 and the outer base wall 20, so that, for example, an exhaust gas outlet pipe discharges exhaust gases from the interior 24 in the area of the two outer base walls 20, 22, respectively.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

a housing comprised of a circumferential wall;

two base walls connected to the circumferential wall, wherein at least one resonator chamber is defined by the circumferential wall and the two base walls and is provided in the housing;

at least one resonator pipe with a first pipe end and with a second pipe end, the resonator pipe being connected to one of the base walls in an area of a first opening in the one of the base walls or traverses the one base wall such that the first pipe end lies outside of the resonator chamber, or the resonator pipe being connected to one of the base walls in the area of the first opening in the one of the base walls and traverses the one base wall such that the first pipe end lies outside of the resonator chamber, the second pipe end being fixed to another of the base walls, wherein a bulge formed on the another of the base walls engages into the resonator pipe at the second pipe end, the second pipe end being in flush contact with the another of the base walls, the resonator pipe comprising an interior space, at least a portion of the bulge being arranged in the interior space.

2. A muffler in accordance with claim 1, wherein the second pipe end is fixed to the other of the base walls by a material connection, the bulge extending in a direction of the resonator chamber, wherein the bulge meshes with the interior of the resonator pipe at the second pipe end.

3. A muffler in accordance with claim 1, wherein the second pipe end is fixed to the other of the base walls by a weld, the bulge extending in a direction of the resonator chamber, the bulge comprising a bulge outer surface, the resonator pipe comprising a resonator pipe inner surface, at least a portion of the resonator pipe inner surface being in direct contact with the bulge outer surface.

4. A muffler in accordance with claim 1, wherein the resonator pipe, starting from the first pipe end, comprises a first resonator pipe section with a pipe wall without an opening and starting from the second pipe end comprises a second resonator pipe section connected to the first resonator pipe section, the resonator pipe being open toward the resonator chamber in the area of the second resonator pipe section, the bulge extending in a direction of the resonator chamber, the bulge comprising a bulge outer surface, the resonator pipe comprising a resonator pipe inner surface, at least a portion of the resonator pipe inner surface engaging at least a portion of the bulge outer surface.

5. A muffler in accordance with claim 4, wherein the resonator pipe has a plurality of openings in the second resonator pipe section.

6. A muffler in accordance with claim 4, wherein the resonator pipe has a plurality of holes in the second resonator pipe section.

7. A muffler in accordance with claim 4, wherein the resonator pipe has at least one elongated opening in the second resonator pipe section.

8. A muffler in accordance with claim 7, wherein:

the at least one elongated opening is essentially elongated in a resonator pipe longitudinal direction; or the at least one elongated opening is open toward the second pipe end; or the at least one elongated opening is essentially elongated in a resonator pipe longitudinal direction and the at least one elongated opening is open toward the second pipe end.

9. A muffler in accordance with claim 1, further comprising at least one exhaust gas outlet pipe connected to the one of the base walls in an area of a second opening in the one of the base walls and connected to the other of the base walls in an area of a third opening in the other of the base walls.

10. A muffler in accordance with claim 1, wherein:

the one of the base walls is an inner base wall separating the resonator chamber from an exhaust gas-carrying chamber; or the other of the base walls is an outer base wall closing the housing to an outside; or the one of the base walls is an inner base wall separating the resonator chamber from an exhaust gas-carrying chamber and the other of the base walls is an outer base wall closing the housing to an outside.

11. A muffler in accordance with claim 10, wherein:

the muffler further comprises an exhaust gas inlet pipe introducing exhaust gas into the exhaust gas-carrying chamber; or the first pipe end of the resonator pipe lies in the exhaust gas-carrying chamber; or the muffler further comprises an exhaust gas inlet pipe introducing exhaust gas into the exhaust gas-carrying chamber and the first pipe end of the resonator pipe lies in the exhaust gas-carrying chamber.

12. An exhaust system for an internal combustion engine, comprising:

an exhaust carrying pipe; and a muffler connected to the exhaust carrying pipe, the muffler comprising:

a housing comprised of a circumferential wall;

two base walls connected to the circumferential wall, wherein at least one resonator chamber is defined by the circumferential wall and the two base walls and is provided in the housing;

at least one resonator pipe with a first pipe end and with a second pipe end, the resonator pipe being connected to one of the base walls in an area of a first opening in the one of the base walls or traverses the one base wall such that the first pipe end lies outside of the resonator chamber, or the resonator pipe being connected to one of the base walls in the area of the first opening in the one of the base walls and traverses the one base wall such that the first pipe end lies outside of the resonator chamber, the second pipe end being fixed to another of the base walls, wherein a bulge formed on the another of the base walls engages into the resonator pipe at the second pipe end, the second pipe end being in flush contact with the another of the base walls, the resonator pipe comprising an interior space, at least a portion of the bulge being arranged in the interior space.

13. An exhaust system in accordance with claim 12, wherein the second pipe end is fixed to the other of the base walls by a material connection, the bulge extending in a direction of the resonator chamber, wherein the bulge meshes with the interior of the resonator pipe at the second pipe end.

14. An exhaust system in accordance with claim 12, wherein the resonator pipe, starting from the first pipe end, comprises a first resonator pipe section with a pipe wall without an opening and starting from the second pipe end comprises a second resonator pipe section connected to the first resonator pipe section, the resonator pipe being open toward the resonator chamber in the area of the second resonator pipe section, the bulge extending in a direction of the resonator chamber, the bulge comprising a bulge outer surface, the resonator pipe comprising a resonator pipe inner surface, at least a portion of the resonator pipe inner surface being in direct contact with the bulge outer surface.

15. An exhaust system in accordance with claim 14, wherein:

the bulge extends in a direction of the resonator chamber;

the bulge comprises a bulge outer surface;

the resonator pipe comprises a resonator pipe inner surface;

at least a portion of the resonator pipe inner surface engages at least a portion of the bulge outer surface;

the resonator pipe has at least one elongated opening in the second resonator pipe section; and the at least one elongated opening is essentially elongated in a resonator pipe longitudinal direction; or the at least one elongated opening is open toward the second pipe end; or the at least one elongated opening is essentially elongated in a resonator pipe longitudinal direction and the at least one elongated opening is open toward the second pipe end.

16. An exhaust system in accordance with claim 12, further comprising at least one exhaust gas outlet pipe connected to the one of the base walls in an area of a second opening in the one of the base walls and connected to the other of the base walls in an area of a third opening in the other of the base walls, wherein at least a portion of the resonator pipe extends about an outer surface of the bulge.

17. An exhaust system in accordance with claim 12, wherein:

the one of the base walls is an inner base wall separating the resonator chamber from an exhaust gas-carrying chamber; or the other of the base walls is an outer base wall closing the housing to an outside; or the one of the base walls is an inner base wall separating the resonator chamber from an exhaust gas-carrying chamber and the other of the base walls is an outer base wall closing the housing to an outside.

18. An exhaust system in accordance with claim 17, wherein:

the exhaust carrying pipe is an exhaust gas inlet pipe introducing exhaust gas into the exhaust gas-carrying chamber; or the first pipe end of the resonator pipe lies in the exhaust gas-carrying chamber; or the muffler further comprises an exhaust gas inlet pipe introducing exhaust gas into the exhaust gas-carrying chamber and the first pipe end of the resonator pipe lies in the exhaust gas-carrying chamber.

19. A muffler for an exhaust system of an internal combustion engine, the muffler comprising:

a housing comprised of a circumferential wall;

two base walls connected to the circumferential wall, wherein at least one resonator chamber is defined by the circumferential wall and the two base walls and is provided in the housing;

at least one resonator pipe with a first pipe end and with a second pipe end, the resonator pipe being connected to one of the base walls in an area of a first opening in the one of the base walls or traverses the one base wall such that the first pipe end lies outside of the resonator chamber, or the resonator pipe being connected to one of the base walls in the area of the first opening in the one of the base walls and traverses the one base wall such that the first pipe end lies outside of the resonator chamber, the second pipe end being fixed to another of the base walls, wherein a bulge formed on the another of the base walls engages into the resonator pipe at the second pipe end, the second pipe end being fixed to the other of the base walls by a material connection, the bulge extending in a direction of the resonator chamber, wherein the bulge meshes with the interior of the resonator pipe at the second pipe end.

* * * * *